United States Patent [19]

Suzuki

[11] Patent Number: 4,715,477

[45] Date of Patent: Dec. 29, 1987

[54] DEVICE FOR FIXING SWING ARM USED FOR APPARATUS FOR LIFTING AUTOMOBILES FOR REPAIR

[75] Inventor: Koichi Suzuki, Aichi, Japan

[73] Assignee: Sugiyasu Industries Co., Ltd., Aichi, Japan

[21] Appl. No.: 887,246

[22] Filed: Jul. 18, 1986

[30] Foreign Application Priority Data

Aug. 23, 1985 [JP] Japan ..... 60-129429[U]

[51] Int. Cl.[4] ..... B66F 7/28

[52] U.S. Cl. ..... 187/8.47; 187/8.5; 187/8.75; 254/89 R

[58] Field of Search ..... 187/8.5, 8.59, 8.67, 187/8.75, 8.74, 8.45, 8.49, 8.47, 8.54, 8.64; 248/419, 425, 352; 414/728; 254/89 R, 134

[56] References Cited

U.S. PATENT DOCUMENTS

| | | | |
|---|---|---|---|
| 4,031,982 | 6/1977 | Lindfors | 187/8.59 |
| 4,105,095 | 8/1978 | Hegenbart | 187/8.75 |

FOREIGN PATENT DOCUMENTS

| | | | |
|---|---|---|---|
| 2751085 | 6/1978 | Fed. Rep. of Germany | 254/89 R |
| 2742518 | 3/1979 | Fed. Rep. of Germany | 254/89 R |
| 2837582 | 3/1980 | Fed. Rep. of Germany | 254/89 R |
| 2841022 | 4/1980 | Fed. Rep. of Germany | 254/89 R |
| 2302272 | 9/1976 | France | 254/89 R |
| 2342240 | 9/1977 | France | 254/89 R |

*Primary Examiner*—Joseph J. Rolla
*Assistant Examiner*—N. Pedersen
*Attorney, Agent, or Firm*—Lahive & Cockfield

[57] ABSTRACT

A device for temporarily fixing a horizontal swing arm used for a car lift apparatus includes a horizontal hollow cylinder connected to the swing arm at its one end portion, a horizontal cylindrical solid rod having one end slidably and rotatably supported in the other end portion of the hollow cylinder, and a cylindrical vertical rod extending through a horizontal bracket projecting from a carriage to which is connected the swing arm and which is connected to a post for vertical movement. The horizontal hollow cylinder and the horizontal cylindrical solid rod are located along the outside of the horizontal swing arm and in alignment with each other. The vertical rod is rotatable about its vertical axis as well as vertically movable. The horizontal rod is connected to the vertical rod at its other end. The hollow cylinder is provided with a lock pin projecting into the cylinder, while a plurality of slots are formed on the circumference of the horizontal rod so that one of the slots may be engaged with the lock pin.

1 Claim, 5 Drawing Figures

DEVICE FOR FIXING SWING ARM USED FOR APPARATUS FOR LIFTING AUTOMOBILES FOR REPAIR

FIELD OF THE INVENTION

This invention relates to a device for temporarily fixing a swing arm used for an apparatus for lifting automobiles for repair.

BACKGROUND OF THE INVENTION

Conventionally, in the apparatus for lifting automobiles for repair, the representative ones of which are those of two-post and four-post types, a vertically-movable carriage connected to a support such as a post has been provided with a pair of swing arms for lifting automobiles which are pivotally connected to the carriage for horizontal or swinging movement. The swing arms may be swung to such horizontal positions as to provide the suitable angle between the two arms for lifting the automobile in a stable manner. Each swing arm is provided with a device for temporarily fixing it in such position lest the swing arm should remove from that position to cause the automobile thereon to drop down during lifting. Many such devices have been proposed, including that disclosed in Japanese Published Examined Patent Application No. 53-3527 "Safety Device for Automobile Support Used for Apparatus for Lifting Automobiles for Repair". However, since the conventional fixing devices have required manual operations for fixing the arms, it has taken much time and trouble to fix them. Also, there were cases where the failure to perform the fixing operations due to carelessness of the personnel resulted in the dropping down of the automobile. Accordingly, the present invention obviates these prior art problems by making automatic the operation of fixing the swing arms.

SUMMARY OF THE INVENTION

The primary object of the invention is to provide a device for automatically fixing swing arms for a car lift apparatus in a temporary manner.

Such a device is provided by making improvements in a prior art swing arm fixing device well known in the art that includes a horizontal hollow cylinder secured to a swing arm pivotally connected to a carriage, a horizontal rod slidably inserted into the hollow cylinder at one end thereof and connected to a bracket projecting from a carriage in the vicinity of the section of the carriage pivotally connecting the swing arm thereto, and a lock means provided in conjunction with the hollow cylinder for engaging one of a plurality of slots formed on the circumference of the horizontal rod and along the lengthwise direction thereof.

Other objects of the invention will become apparent upon consideration of a detailed description of the invention which will follow.

DETAILED DESCRIPTION OF THE PREFERRED EMBODIMENT

Figure 1:
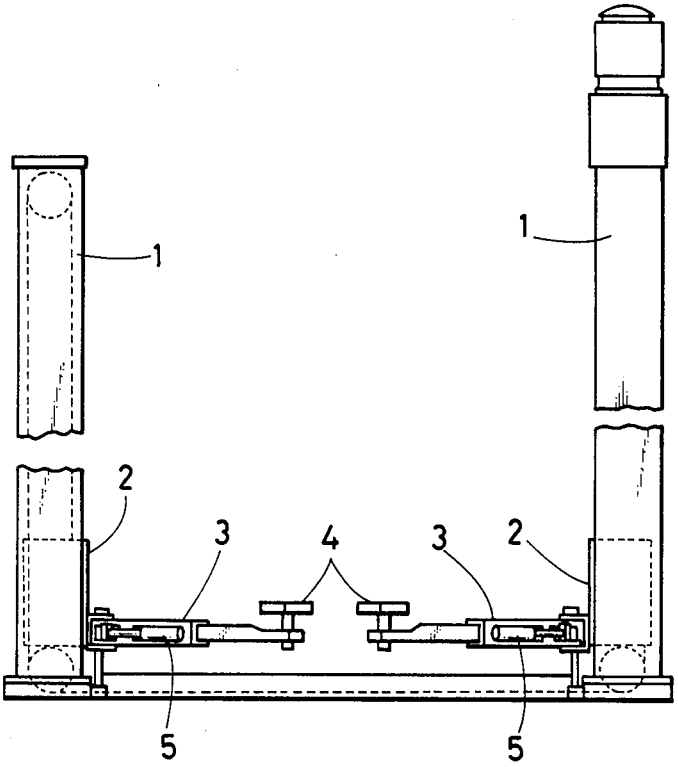
FIG. 1 is a front elevation of a two-post type lift apparatus provided with swing arm fixing devices according to the invention.
Figure 2:
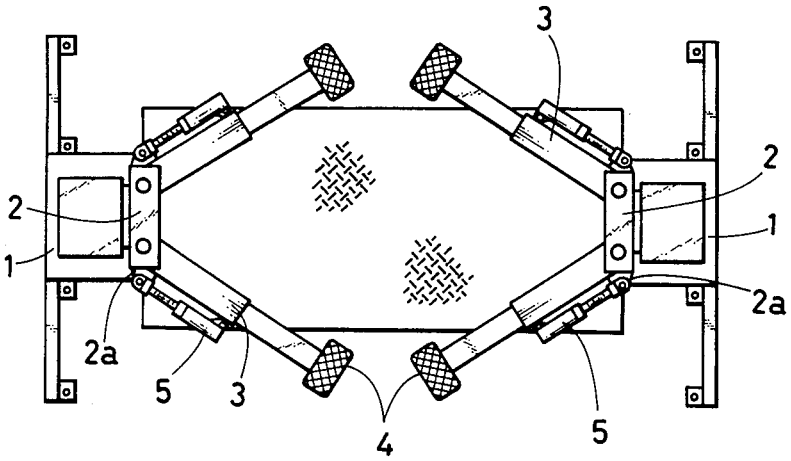
FIG. 2 is a plan view of the apparatus of FIG. 1.

Referring now to the drawings, particularly to FIGS. 1 and 2, a lift apparatus for use in repair of automobiles includes a pair of spaced apart posts 1,1 each having a carriage 2 connected thereto for vertical movement. The carriages 2,2 are adapted to be vertically moved simultaneously with and equally to each other by a certain operating mechanism (not shown). Since this operating mechanism is a conventional one and is not directly relevant to the present invention, a detailed description thereof will be omitted.

A pair of horizontal rectangular swing arms 3 are pivotally connected to each carriage 2 for swinging movement in a horizontal plane and in such a manner that they project toward the other pair of swing arms 3, the connection of the arms 3 to the carriage 2 being made on the lateral end portions thereof. Each pair of swing arms 3 are provided, at the outsides thereof, with a means 5 for temporarily fixing the arm 3 in a certain horizontal position to provide a desired angle between the two arms 3. Each swing arm 3 is telescopically constructed so as to extend or retract in a horizontal plane. At the projecting end of the arm 3 is provided a means 4 for supporting the bottom of a car body. Adjustment of the angle between the swing arms 3 as well as of the projecting amount thereof will enable the suitable lifting points by the support means 4 to be set on the bottom of a particular automobile.

Figure 3:
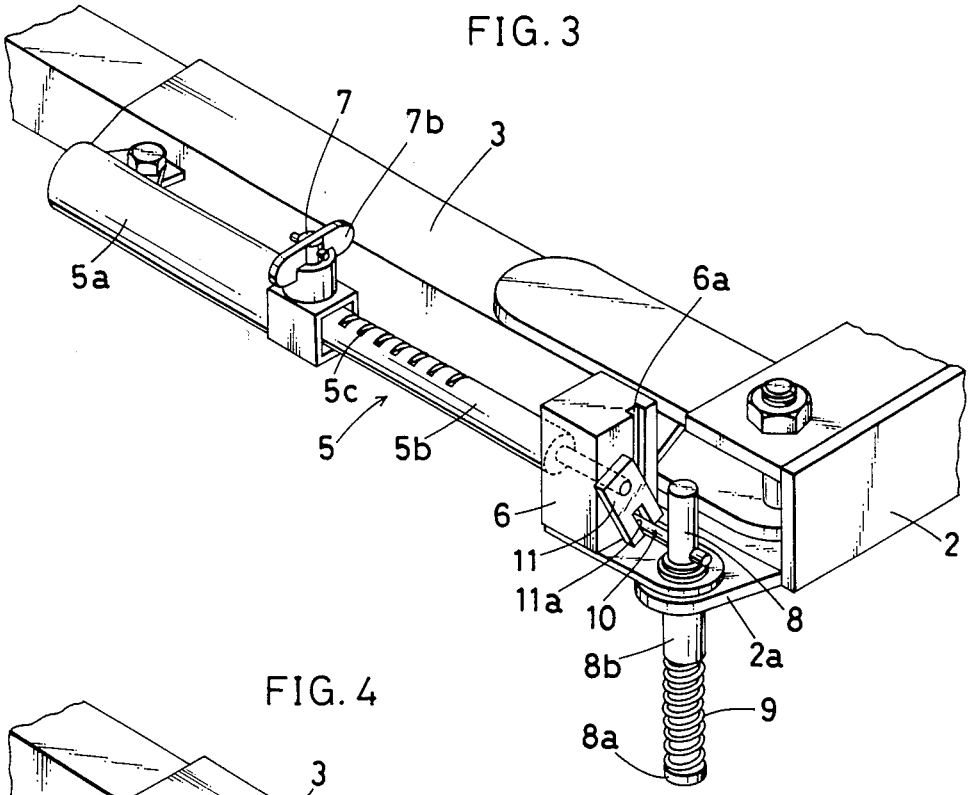
FIG. 3 is an enlarged perspective view of a fixing device of the invention connected to a swing arm, wherein one of the slots in a horizontal rotatable rod of the device is in engagement with a lock pin.
Figure 4:
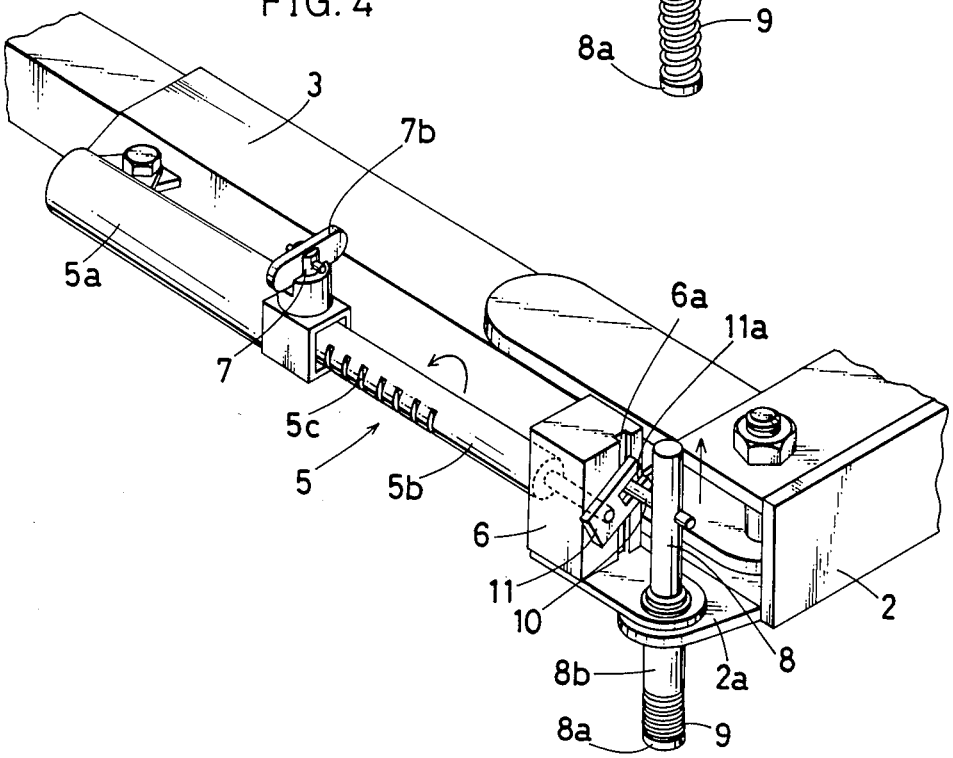
FIG. 4 is a similar view to FIG. 3 wherein the horizontal rod has been rotated from the position of FIG. 3 to that in which no slot in the horizontal rod is in engagement with the lock pin.
Figure 5:
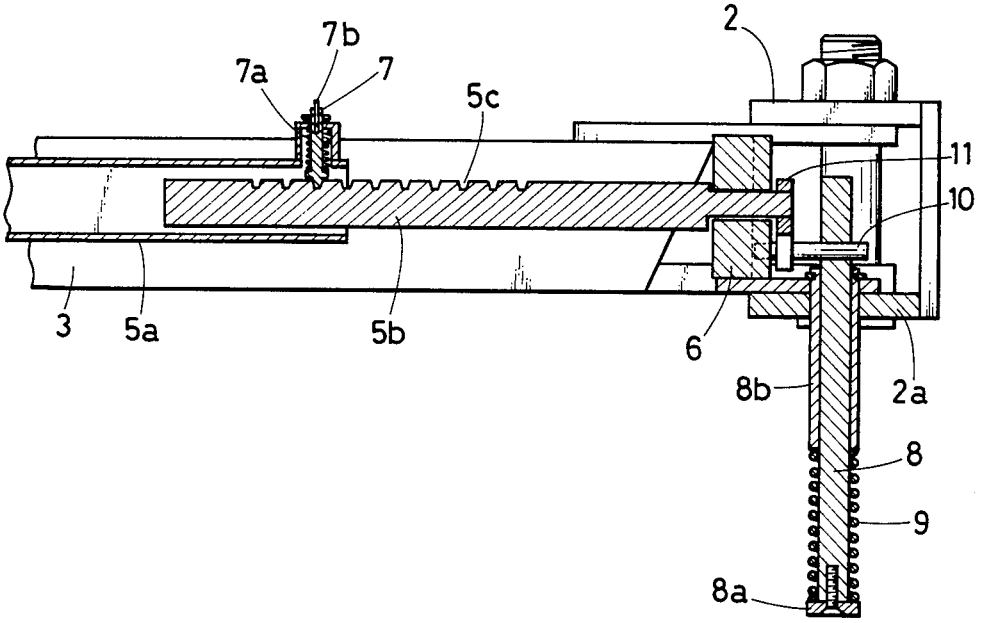
FIG. 5 is a vertical cross section of the fixing device.

Referring to FIGS. 3, 4 and 5, the arm fixing device 5 will now be described. The arm fixing device 5 includes a horizontal hollow cylinder **5*a* connected, at its one end portion, to the outside of the swing arm 3 by means of a bracket, bolt and nut and having an open inward end through which a horizontal cylindrical solid rod 5*b* is slidably inserted into the hollow cylinder 5*a* at its one end portion. As clearly shown in FIGS. 3 and 4, the horizontal cylinder 5*a* and horizontal rod 5*b* are disposed along the outside of the horizontal swing arm 3 are in alignment with each other. The rod 5*b* is connected, at its other end, through a rectangular block 6 to a bracket 2*a* projecting horizontally and outwardly from the carriage 2 in the vicinity of a vertical pivotal pin thereof pivotally connecting the swing arm 3 to the carriage 2. The connection of the slidable rod 5*b* to the bracket 2*a* is so made that the former can be rotated about its horizontal axis. The end of the rod 5*b* entering the hollow cylinder 5*a* is a free end, and is allowed to slide on the lower inner surface of the hollow cylinder 5*a* and along the length of the cylinder 5*a*, relative to the cylinder 5*a*, when the swing arm 3 is swung. This slidable rod 5*b* is provided with a plurality of slots 5*c* formed on part of the upper portion of the circumference thereof, which extend from the substantially middle section of the rod 5*b* toward its end inserted into the cylinder 5*a*. The slots 5*c* are arranged along the length of the rod 5*b* at regular intervals, and are substantially parallel to one another, each extending in directions substantially perpendicular to the length of the rod 5*b*. A rectangular frame is attached to the open end of the cylinder 5*a*, the latter being surrounded by the former. This frame is provided, on its top, with an upwardlyprojecting cylindrical hollow guide whose inner space communicates with that of the frame. An opening is made through the portion of the wall of the cylinder 5a which is in alignment with the inner space of the guide. A vertical lock pin 7 is inserted into the hollow guide and the frame, together with a spring 7a provided around the lock pin 7 for urging it, at all times, downward or toward the portion of the rod 5b entering into the cylinder 5a so that the lower end of the lock pin 7 may engage one of the slots 5c of the rod 5b. A handle 7b is connected to the top of the lock pin 7. This handle 7b** may be operated in a vertical plane.

A cylindrical rod 8 extends vertically through the horizontal bracket 2a, with a spring 9 provided therearound for urging it downward at all times. This rod 8 is not only rotatable about its vertical axis, but also vertically movable. An annular element 8b is fitted over a portion of the rod 8 positioned below the bracket 2a in such a manner that the element 8b may be slided along and relative to the foregoing portion of the rod 8. A disc 8a with substantially the same diameter as the outside diameter of the annular element 8b is connected to the lower end of the rod 8. The foregoing spring 9 is disposed between the annular element 8b and the disc 8a. The disc 8a is always in a lower position than the carriage 2, and is adapted to be placed on the immovable surface on which the lift apparatus is installed or on an immovable base of the apparatus when the carriage 2 is in its lowest position.

A pin 10 is secured to a portion of the movable rod 8 that is positioned above the bracket 2a, extending horizontally through that portion of the rod 8 at one end portion thereof. The aforementioned rectangular block 6 is supported on a flat base pivotally connected to the rod 8, so that the block 6 may be turned with the rotary movement of the flat base about the rod 8. Also, the block 6 is provided, on its rear side, with a vertically extending groove 6a. The foregoing pin 10 is fitted into this groove 6a at its other end in such a manner that the pin 10 slides along the groove 6a while vertically moving as the rod 8 is vertically moved. Also, as clearly seen from FIGS. 3 and 4, the horizontal pin 10 functions to prevent the rod 8 from being lowered by more than a given distance. The rotatable rod 5b is formed into a smaller-diameter section, at its end portion extending through the rectangular block 6, and a rectangular plate 11 is secured to the end of the smaller-diameter section that projects from the block 6. The rectangular plate 11 is cut away at a portion thereof to provide a rectangular recess 11a. The slidable pin 10 passes through this recess 11a at its portion slightly backward of its end fitted into the groove 6a of the block 6, while the recess 11a is adapted always to accompany the slidable pin 10 as it moves vertically. Thus, when the pin 10 is slided along the groove 6a with the vertical movement of the rod 8, the plate 11 makes arcing movements to rotate the rod 5b.

Description will next be made of the operation of the arm fixing device 5 described above. When the carriage is in its lowest position with the lower end 8a of the vertical rod 8 in contact with the surface on which the car lift apparatus is installed, the slidable pin 10 of the vertical rod 8 is positioning the recess 11a of the rectangular plate 11 in the upper place, thus disposing the slots 5c in the rotatable rod 5b in positions rotated counterclockwise from their upper positions so that the slot 5c is out of engagement with the lock pin 7 (FIG. 4). Thus, in this condition, the swing arm 3 may be swung in either horizontal direction so as to come to a suitable position to support the bottom of a car body.

Then, when the carriage 2 is raised, the lower end 8a of the rod 8 goes away from the foregoing installation surface, so that the rod 8 is lowered, relative to the bracket 2a, by the action of the spring 9 while its pin 10 slides down, along the groove 6a, to its lowest position so as to rotate the slidable rod 5b clockwise, locating one of the slots 5c thereof (through the rectangular plate 11) in the position where it is engaged with the lock pin 7 (FIG. 3). The engagement of the slot 5c with the lock pin 7 is automatically made since the latter is at all times urged downward as previously mentioned. The swing arm 3 is thus automatically fixed to prevent the automobile thereon from dropping down by accident. It may be understood that the particular slot 5c engaged by the lock pin 7 is determined by the length of the portion of the slidable rod 5b entering the cylinder 5a which depends upon the angle of rotation of the swing arm 3 about the pivotal pin of the carriage 2.

When the carriage 2 has been brought down to its lowest position after repair of the automobile, the slot 5c is disengaged from the lock pin 7 so as to unfix the swing arm 3 (FIG. 4).

As may be seen from the foregoing description, according to the invention, the swing arm is automatically and certainly fixed as well as automatically unfixed as the carriage is vertically moved.

If desired, when the slot 5c of the slidable rod 5b is in the position as shown in FIG. 3, the handle 7b for the lock pin 7 may be operated to engage or disengage the pin 7 with or from the slot. In other words, the swing arm 3 may be manually fixed or unfixed.

It may be understood that the timing of engagement and disengagement of the slot 5c with and from the lock pin 7 may be varied by replacing the vertical rod 8 with another one having a different length.

If desired, a screw instead of the spring 7a may be used to hold the lock pin 7. Also, a plate-shaped element instead of the pin 7 may be used as a means for performing the same function. Furthermore, modifications may be made as to the position of installation of the fixing device, the arrangement for connecting the vertical rod 8 and horizontal rod 5b to each other, and the like.

Moreover, the present fixing device obviously may be used not only for two-post type lift apparatuses, but also for other various kinds of lift systems with swing arms.

Many other variations of the invention will be apparent to those skilled in the art. Accordingly, the invention is not considered to be limited to the specific embodiment described herein, but only as set forth by the appended claim.

What is claimed is:

1. In an apparatus for lifting automobiles for repair thereof, comprising a pair of spaced posts, each post having a carriage which is connected thereto for vertical movement; a pair of horizontal swing arms pivotally connected to each carriage for swinging movement in a horizontal plane, each swing arm having a car body support means at its one end, and a device for temporarily fixing the swing arm in its desired horizontal position so as to temporarily fix the two swing arms with a desired angle therebetween, which device comprises (A) a horizontal hollow cylinder connected to one side of the swing arm at its one end portion and extending along a swing arm and (B) a horizontal cylindrical solid rod which is disposed along the swing arm in alignment with said hollow cylinder and is rotatably and slidably supported in the other end portion of said hollow cylinder at its one end portion, and which is connected, at its other end, to a horizontal bracket projecting from the carriage toward the same side as said solid rod and hollow cylinder in the vicinity of the section of the carriage pivotally connecting swing arm thereto, and which is provided with a plurality of transverse slots formed on a portion of the circumference of said solid rod substantially parallel to one another and along the lengthwise direction thereof, said hollow cylinder being provided with a lock means for engaging one of said slots for temporarily fixing the swing arm in a desired horizontal position, wherein the improvement comprises:

a. a vertical rod means adapted for vertical movement and rotation about its vertical axis, said rod means being downwardly biased by a biasing means and extending vertically through said horizontal bracket, said rod means having a lower end disposed in a position lower than said carriage;

b. a means for supporting said horizontal rod and for facilitating the rotation of said horizontal rod upon the vertical movement of said vertical rod means;

c. means responsive to the movement of said vertical rod to its lowest position relative said carraige for rotating said horizontal rod to a position where one of said slots of said horizontal rod engages said lock means; and d. means for effecting the disengagement of said lock means and said slot on said horizontal rod upon the lowering of said carriage beyond a predetermined level.

* * * * *